US006033317A

United States Patent [19]

Beam

[11] Patent Number: 6,033,317

[45] Date of Patent: Mar. 7, 2000

[54] GOLFING AID

[76] Inventor: David H. Beam, P.O. Box 623, Forest Ranch, Calif. 95942

[21] Appl. No.: 09/178,597

[22] Filed: Oct. 26, 1998

[51] Int. Cl.[7] ..... A63B 69/36

[52] U.S. Cl. ..... 473/279

[58] Field of Search ..... 473/278, 279

[56] References Cited

U.S. PATENT DOCUMENTS 5,460,379 10/1995 Cleland ..... 473/279

*Primary Examiner*—George J. Marlo

[57] ABSTRACT

A golfing aid is disclosed. The golfing aid has an upper rectangular plate having a lower surface and an upper surface adapted to receive a golfer thereon. A lower rectangular plate is provided having an upper surface and a lower surface positionable on the ground. The upper and lower plates each have a front edge, a rear edge, a toe edge and a heel edge. A first box is adjustably positionable upon the lower plate. The first box has parallel first and second plates and parallel third and fourth plates with two parallel adjustment rods extending through two of the plates. The adjustment rods have adjustment handles adapted to extend a downwardly projecting support surface selectively at the will of an operator. Each front and rear face of the lower first box is provided with an opening. A second box is adjustably positionable beneath the lower surface of the upper plate. The upper plate has parallel first and second plates and parallel third and fourth plates with a rod extending through the front face and the rear face of the lower box with its ends being locatable in a preselected part of the opening to vary the angular orientation of the upper plate and upper adjustment box.

1 Claim, 2 Drawing Sheets

GOLFING AID

BACKGROUND OF THE INVENTION

1. Field of the Invention

The present invention relates to a new and improved golfing aid for practicing shots at different orientations of the ground and, more particularly, pertains to assisting a golfer to take a stance over a ball to be struck in any of a plurality of angular orientations.

2. Description of the Prior Art

The use of golfing aids of known designs and configurations is known in the prior art. More specifically, golfing aids of known designs and configurations heretofore devised and utilized for the purpose of assisting golfers in practicing their swings through known methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of golfing aids of known designs and configurations. By way of example, U.S. Pat. No. 2,879,996 to Lederer, issued Mar. 31, 1959, discloses a golf practicing machine. U.S. Pat. No. 2,937,875 to Mason et al., issued May 24, 1960, discloses a golf practice device. U.S. Pat. No. 3,869,127 to Kohori, issued Mar. 4, 1975, discloses a golf-shot practicing apparatus. U.S. Pat. No. 4,875,684 to Benilan, issued Oct. 24, 1989, discloses an orientable platform in particular for training in golf. Lastly, U.S. Pat. No. 5,358,251 to Ashton, issued Oct. 25, 1994, discloses a golf training aid/simulator. Foreign patents EP 0 491 102 A1 to Yan, issue/priority date Dec. 19, 1990, discloses a golf training device and WO 94/01185 to Barrett, issue/priority date Jan. 20, 1994 discloses a golf swing training aid kit.

In this respect, the golfing aid for practicing shots at different orientations of the ground according to the present invention substantially departs from the conventional concepts and designs of the prior art, and in doing so provides an apparatus primarily developed for the purpose of assisting a golfer to take a stance over a ball to be struck in any of a plurality of angular orientations.

Therefore, it can be appreciated that there exists a continuing need for a new and improved golfing aid for practicing shots at different orientations of the ground which can be used for assisting a golfer to take a stance over a ball to be struck in any of a plurality of angular orientations. In this regard, the present invention substantially fulfills this need.

SUMMARY OF THE INVENTION

In view of the foregoing disadvantages inherent in the known types of golfing aids of known designs and configurations now present in the prior art, the present invention provides a new and improved golfing aid for practicing shots at different orientations of the ground. As such, the general purpose of the present invention, which will be described subsequently in greater detail, is to provide a new and improved golfing aid for practicing shots at different orientations of the ground and methods which have all the advantages of the prior art and none of the disadvantages.

To attain this, the present invention essentially comprises a new and improved golfing aid system for assisting a golfer to take a stance over a ball to be struck in any of a plurality of angular of angular orientations comprising, in combination, an upper rectangular plate having a lower surface and an upper surface adapted to receive a golfer thereon; a lower rectangular plate having an upper surface and a lower surface positionable on the ground, the upper and lower plates each having a front edge, a rear edge, a toe edge and a heel edge; a lower box adjustably positionable upon the lower plate, the lower box having parallel front and rear plates and having parallel toe and heel plates with two parallel adjustment rods extending through the front and rear plates with adjustment handles adjacent to the toe edge and heel edge adapted to extend a downwardly projecting support surface selectively at the will of an operator to vary the angular orientation between sidehill lies, each front and rear face of the lower adjustment box being provided with an E-shaped opening; and an upper box adjustably positionable beneath the lower surface of the upper plate and above the lower box, the upper plate having parallel front and rear plates and having parallel toe and heel plates with a rod extending through the front face and the rear face of the lower box with its ends being locatable in a preselected vertical extension of the E-shaped opening to vary the angular orientation of the upper plate and upper adjustment box between an uphill lie and a downhill lie.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golfing aid for practicing shots at different orientations of the ground which has all the advantages of the prior art golfing aids of known designs and configurations and none of the disadvantages.

It is another object of the present invention to provide a new and improved golfing aid for practicing shots at different orientations of the ground which may be easily and efficiently manufactured and marketed.

It is a further object of the present invention to provide a new and improved golfing aid for practicing shots at different orientations of the ground which is of a durable and reliable construction.

An even further object of the present invention is to provide a new and improved golfing aid for practicing shots at different orientations of the ground which is susceptible of a low cost of manufacture with regard to both materials and labor, and which accordingly is then susceptible of low prices of sale to the consuming public, thereby making such a golfing aid for practicing shots at different orientations of the ground economically available to the buying public.

Even still another object of the present invention is to assist a golfer to take a stance over a ball to be struck in any of a plurality of angular orientations.

Lastly, it is an object of the present invention to provide a golfing aid. The golfing aid has an upper rectangular plate having a lower surface and an upper surface adapted to receive a golfer thereon. A lower rectangular plate is provided having an upper surface and a lower surface positionable on the ground. The upper and lower plates each have a front edge, a rear edge, a toe edge and a heel edge. A first box is adjustably positionable upon the lower plate. The first box has parallel first and second plates and parallel third and fourth plates with two parallel adjustment rods extending through two of the plates. The adjustment rods have adjustment handles adapted to extend a downwardly projecting support surface selectively at the will of an operator. Each front and rear face of the lower first box is provided with an opening. A second box is adjustably positionable beneath the lower surface of the upper plate. The upper plate has parallel first and second plates and parallel third and fourth plates with a rod extending through the front face and the rear face of the lower box with its ends being locatable in a preselected part of the opening to vary the angular orientation of the upper plate and upper adjustment box.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
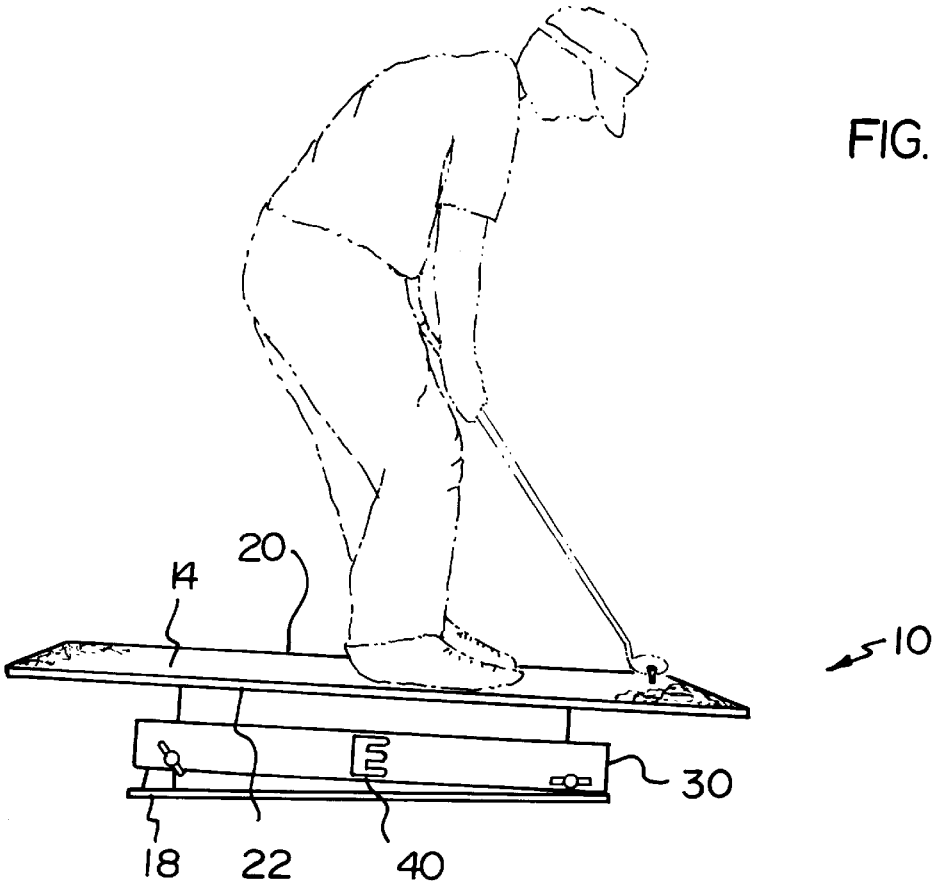
FIG. 1 is a perspective illustration of the new and improved golfing aid constructed in accordance with the principles of the present invention.
Figure 2:
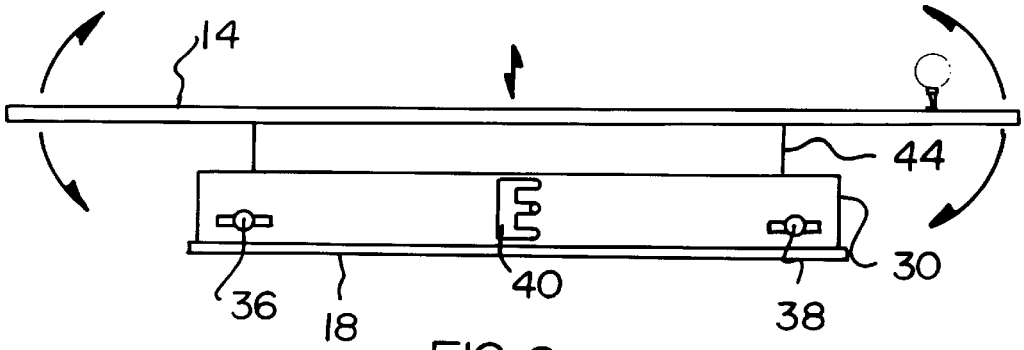
FIG. 2 is a rear elevational view of the device shown in FIG. 1.
Figure 3:
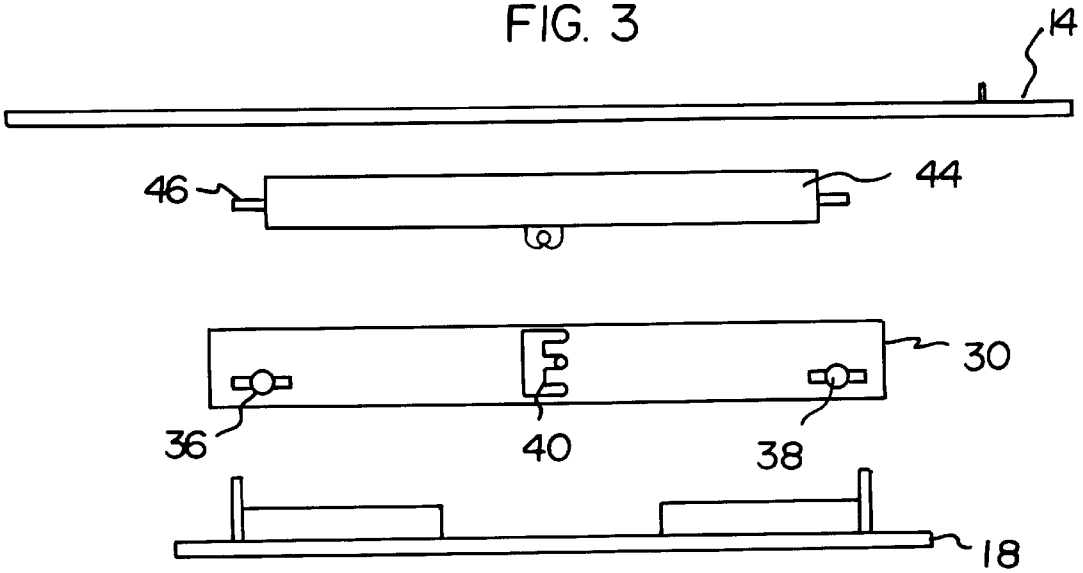
FIG. 3 is an exploded view of the apparatus shown in FIG. 2.
Figure 4:
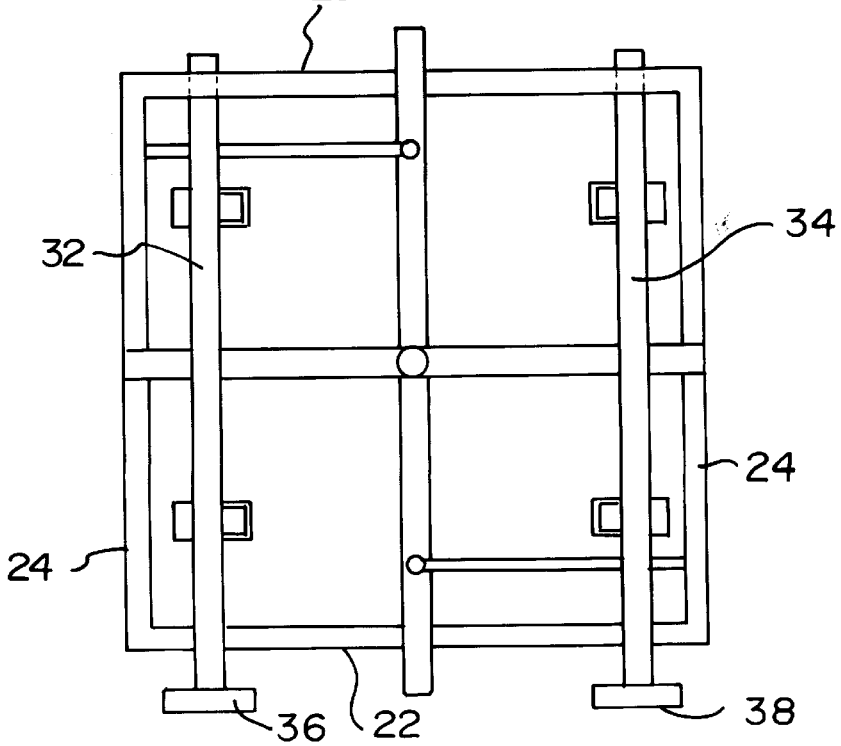
FIG. 4 is a top elevational view of the device of the prior Figures with the upper plate removed.

With reference now to the drawings, and in particular to FIGS. 1 through 4 thereof, the new and improved golfing aid for practicing shots at different orientations of the ground embodying the principles and concepts of the present invention and generally designated by the reference numeral 10 will be described.

The present invention, the new and improved golfing aid for practicing shots at different orientations of the ground is a system 10 comprised of a plurality of components. Such components, in their broadest context, include an upper plate, a lower plate, an upper adjustment box and a lower adjustment box. Each of the individual components is specifically configured and correlated one with respect to the other so as to attain the desired objectives.

The present invention is a new and improved golfing aid system 10 for assisting a golfer to take a stance over a ball to be struck in any of a plurality of angular of angular orientations. The first component of the system is an upper rectangular plate 14. The plate has a lower surface and an upper surface adapted to receive a golfer thereon.

Also provided is a lower rectangular plate 18. The lower plate has an upper surface and a lower surface positionable on the ground. The upper and lower plates each have a front edge 20, a rear edge 22, a toe edge and a heel edge 24.

The next component of the system is a lower box 30. The lower box is adjustably positionable upon the lower plate. The lower box has parallel front and rear plates and parallel toe and heel plates with two parallel adjustment rods 32, 34 extending through the front and rear plates. Adjustment handles 36, 38 are provided adjacent to the toe edge and heel edge and are adapted to extend a downwardly projecting support surface selectively at the will of an operator to vary the angular orientation between sidehill lies. Each front and rear face of the lower adjustment box is provided with an E-shaped opening 40.

Lastly provided as part of the system is an upper box 44 adjustably positionable beneath the lower surface of the upper plate and above the lower box. The upper plate has parallel front and rear plates and parallel toe and heel plates with a rod 46 extending through the front face and the rear face of the lower box. The ends of the rod are locatable in a preselected vertical extension of the E-shaped opening to vary the angular orientation of the upper plate and upper adjustment box between an uphill lie and a downhill lie.

The present invention is an adjustable platform which allows golfers to practice uneven lies. The device has been specifically designed to enable the golfer to practice shots on uneven terrain. With its adjustable platform, a golfer can practice uphill shots, downhill shots, and a variety of angles and inclines.

The surface of the golf training aid measures four feet square and is covered with a synthetic grass material. The base of the training aid is comprised of aluminum and reinforced steel components. Between the two levels are a set of elevator bars which enable the user to move one side of the surface up or down. By using these elevator bars in combination, the golfer is able to simulate the actual lie of the fairways on the golf course.

The present invention could be available through the golf course or sold to individuals for use at home. One of the advantages of being able to change the angles of the platform is that the golfer is able to simulate the actual conditions experienced at his or her favorite course. Uneven lies create unfamiliar golf stances. Difficult flight patterns of the ball are also created, as for example, the ball beneath the feet creating a fade. The present invention allows the golfer the familiarity of a difficult ball lie prior to experiencing it on any golf course.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved golfing aid system for assisting a golfer to take a stance over a ball to be struck in any of a plurality of angular orientations comprising, in combination:

an upper rectangular plate having a lower surface and an upper surface adapted to receive a golfer thereon;

a lower rectangular plate having an upper surface and a lower surface positionable on the ground, the upper and lower plates each having a front edge, a rear edge, a toe edge and a heel edge;

a lower box adjustably positionable upon the lower plate, the lower box having parallel front and rear plates and having parallel toe and heel plates with two parallel adjustment rods extending through the front and rear plates with adjustment handles adjacent to the toe edge and heel edge adapted to extend a downwardly projecting support surface selectively at the will of an operator to contact an upper region of the lower rectangular plate for varying the angular orientation between sidehill lies, each front and rear face of the lower adjustment box being provided with an E-shaped opening; and an upper box adjustably positionable beneath the lower surface of the upper plate and above the lower box, the upper box having parallel front and rear plates and the upper box also having parallel toe and heel plates with a rod extending through the front plate and the rear plate of the lower box with its ends being locatable in a preselected vertical extension of the E-shaped opening to vary the angular orientation of the upper plate and upper adjustment box between an uphill lie and a downhill lie.

* * * * *